United States Patent [19]

Uphues

[11] 4,347,962

[45] Sep. 7, 1982

[54] BRAKE ROLL FOR SPANNING SEVERAL BANDS

[75] Inventor: Ewald Uphues, Hemer, Fed. Rep. of Germany

[73] Assignee: Sundwiger Eisenhütte Maschinenfabrik Grah & Co., Hemer-Sundwig, Fed. Rep. of Germany

[21] Appl. No.: 179,673

[22] Filed: Aug. 20, 1980

[30] Foreign Application Priority Data

Aug. 21, 1979 [DE] Fed. Rep. of Germany ..... 2933775

[51] Int. Cl.[3] ..... B65H 23/08

[52] U.S. Cl. ..... 226/195; 242/75.2; 100/163 R

[58] Field of Search ..... 226/195, 190, 191; 242/156, 75, 75.2, 76; 100/155 R, 163 R

[56] References Cited

U.S. PATENT DOCUMENTS

| | | | |
|---|---|---|---|
| 3,111,285 | 11/1963 | Coker et al. | 242/75.2 |
| 3,468,494 | 9/1969 | Gaudin | 242/75.2 |
| 3,666,195 | 5/1972 | Gaudin | 242/75.2 |
| 3,685,711 | 8/1972 | Gay | 226/191 |

*Primary Examiner*—Leonard D. Christian
*Attorney, Agent, or Firm*—Kenyon & Kenyon

[57] ABSTRACT

Web unwound from a supply roll is slit into a plurality of bands by a slitting unit comprising circular disc blades. The individual bands are subjected to tension by a brake roll assembly positioned before the take up roll to hold the individual bands taut with a predetermined braking force in such manner that different degrees of slippage relative to the brake roll and the individual bands are effected.

7 Claims, 6 Drawing Figures

A
B
C
D
14
15
15'
16
17
18
18'
19
20
21
22
23
24
25

BRAKE ROLL FOR SPANNING SEVERAL BANDS

When winding bands onto a joint reel it is necessary to keep the individual bands taut. This requirement is particularly important in splitting units in which a band unwound from a discharge reel is sub-divided by shears into several narrower bands and the narrow bands divided in this way are conducted to a feed reel. As the individual narrow bands differ in thickness a difference in diameter of wound band results on the feed reel for the individual bands, which leads to the individual bands being wound up at differing speed. So that the bands are wound onto the feed reel under tension in spite of this a brake roll or a brake roll combination, which holds the individual bands taut with a predetermined braking force, is positioned in front of the feed reel. This is arranged in such a manner that the individual bands run over the brake roll or brake roll combination with more or less heavy slippage.

As slippage between the brake roll and the band surface is unfavourable, in a known brake roll (German Pat. No. 169 016), from which the invention works, a plurality of adjacent runner rings is slidingly disposed on a stationary or actuated shaft. Every runner ring is provided with at least one radially pressure-loaded brake member which extends over the entire axial width of the runner ring so that the rest of the peripheral area of the runner ring is available as running zone and forms a slide bearing with the shaft. This slide bearing accepts the forces from the outside (band pull and possibly contact pressure from a counter roll) and the weight of the runner ring. It is however also a responsible for guiding the runner ring on the shaft sufficiently exactly. The rotation resistance of the runner ring, which is taken along with the band without slippage, in relation to the shaft determining the tension of the band is applied by braking the runner ring in the braking zone determines by the brake members. Due to the forces acting from outside, the inner part, e.g. the shaft, and the outer part, e.g. the runner ring, assume an eccentric position corresponding to the guide clearance present. When the shaft is actuated an air gap circulating relatively to the elements of the brake roll results. For the set brake member this means constant up and down movement corresponding to the air gap for each revolution of the shaft. The guide clearance which increases as the time of operation increases therefore has an unfavourable effect on the lateral support of the brake segments and their setting elements. If the brake rolls run at high speed considerable oscillations can be caused due to the guide clearance. Since the guide clearance is not only caused by abrasion between the running zone in the runner rings and the shaft but also by the braking abrasion on the shaft, a guide clearance which exceeds the maximum guide clearance permitted results after a relatively short period of operation.

An attempt was made to overcome the above mentioned problems in the known brake roll with another known brake roll (German Auslegeschrift No. 1 804 178) by disposing the runner rings on roller bearings and arranging the brake members between the individual runner rings. Such a brake roll entails additional expense due to the roller bearing and frequently does not permit sufficiently narrow runner rings.

Finally, a brake roll with several brake rings loosely disposed adjacently on a shaft is known (German Auslegeschrift No. 1 273 294) in which the brake rings can be individually braked by brake elements adjustable from the outside. The brake elements therefore have direct effect on the running surfaces which act together with the bands to be held under tension. The running surfaces of the runner rings must therefore be dimensioned according to the bands on the one hand and according to the brake elements on the other. An optimum design for the bands and the optimum braking characteristics for the brake elements is not possible because of the compromise which would be necessary.

Working from the first mentioned prior art, the invention relates to a brake roll for spanning several, adjacently guided bands comprising stationary or driven shaft and runner rings slidingly disposed thereon which can be braked in relation to the shaft by radially loaded brake members.

The object of the invention is to provide such a brake roll, the time of operation of which up until the maximum guide clearance permitted is achieved is longer.

This object is solved according to the invention in that of the parts disposed on one another (shaft with inset brake members and runner rings) the more heavily abrading part (shaft with inset brake members or runner rings) is divided up into running and braking zone. This division can be realised in different ways. In one embodiment the more heavily abrading part is divided in peripheral direction whereas in another embodiment the more heavily abrading part is divided in axial direction.

The separation of running zone and braking zone in the more heavily abrading part enables the running abrasion to be less than the (theoretical) average total abrasion as from a specific ratio. This results in the time of operation up until the maximum guide clearance permitted is reached being extended in relation to brake rolls in which braking abrasion adds to the running abrasion.

Of the two alternative embodiments the one with division of the running and braking zone in axial direction is above all favourable since in this embodiment the running zone is not interrupted in peripheral direction. In addition to the advantage of longer time of operation, therefore, there is also the advantage of the exactly circular course. Moreover, the axial division provides the following possible variations:

(a) that the more heavily abrading part lies on the outside, (b) the more heavily abrading part lies on the inside, (c) the more heavily abrading part lies on the inside and the surface between the brake members in peripheral direction serves as additional running zone.

According to a further development of the invention the brake members are put under pressure load by pneumatic or hydraulic means. The brake members are preferably arranged in the shaft and are supported on a joint pressure pad. This means that each brake member is under the same pressure load.

The invention is explained in more detail below by way of a drawing showing an embodiment.

Figure 1:
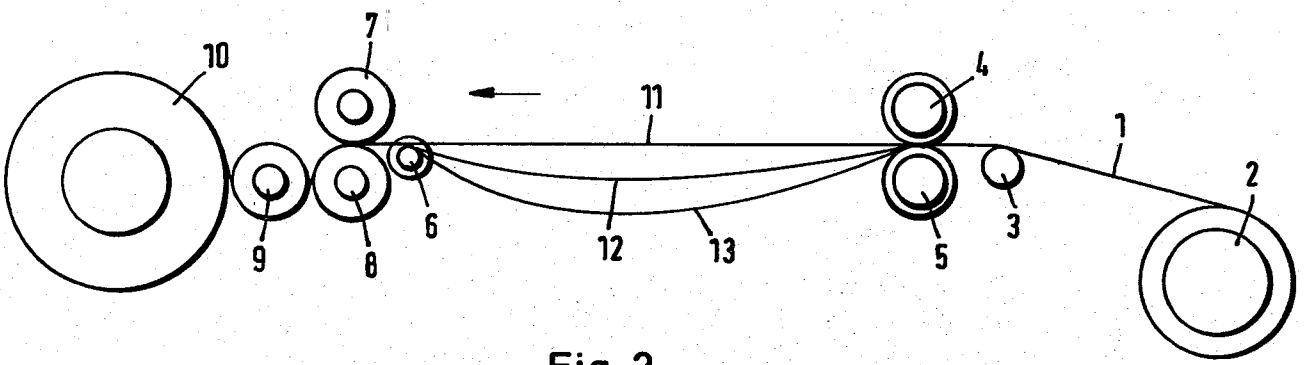
FIG. 1 shows a schematic side view of a splitting unit.
Figure 2:
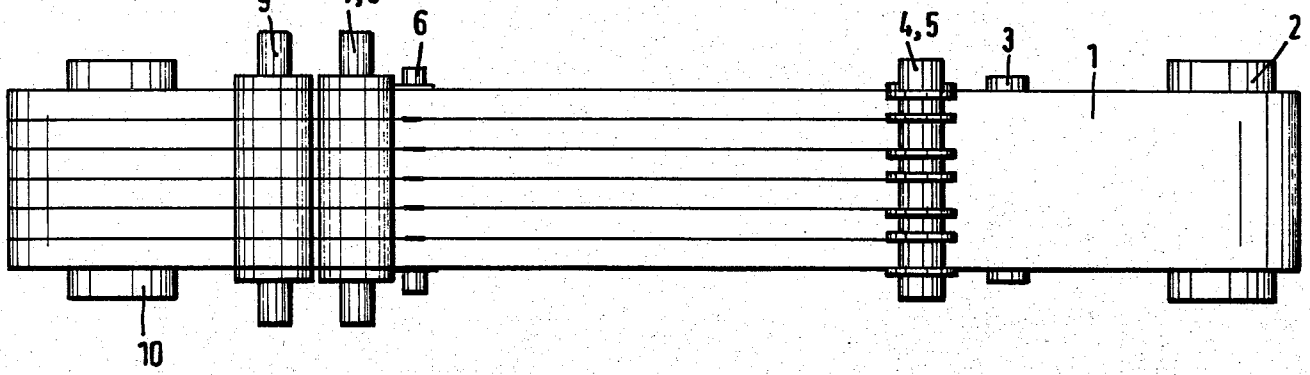
FIG. 2 shows a schematic top view of the splitting unit according to FIG. 1.

The splitting unit according to FIGS. 1 and 2 comprises a discharge reel 2 bearing a band 1, a supporting roll 3 arranged behind the discharge reel 2 in the running direction of the band, a longitudinal shearing unit composed of a plurality of adjacent pairs of circular disc blades 4,5, a further guide roll 6, a brake roll combination 7,8,9 and a take up reel 10. The band 1 wound off the discharge reel 2 is divided in the shearing unit 4,5 into a plurality of adjacently guided bands 11,12,13 which have a different amount of sag between the shearing unit 4,5 and the guide roll 6.

The difference in the amount of sag occurs because of differences in the diameters of wound band on the wind on reel due to the different widths of band. The individual bands are each held under tension by the brake roll combination 7,8,9 which is positioned in front of the wind on reel 10 and which the individual bands 11,12,13 pass through. The brake roll combination 7,8,9 is actuated in such a way that it rotates at a speed slightly less than the slowest band.

Figures 3, 4, 5, 6:
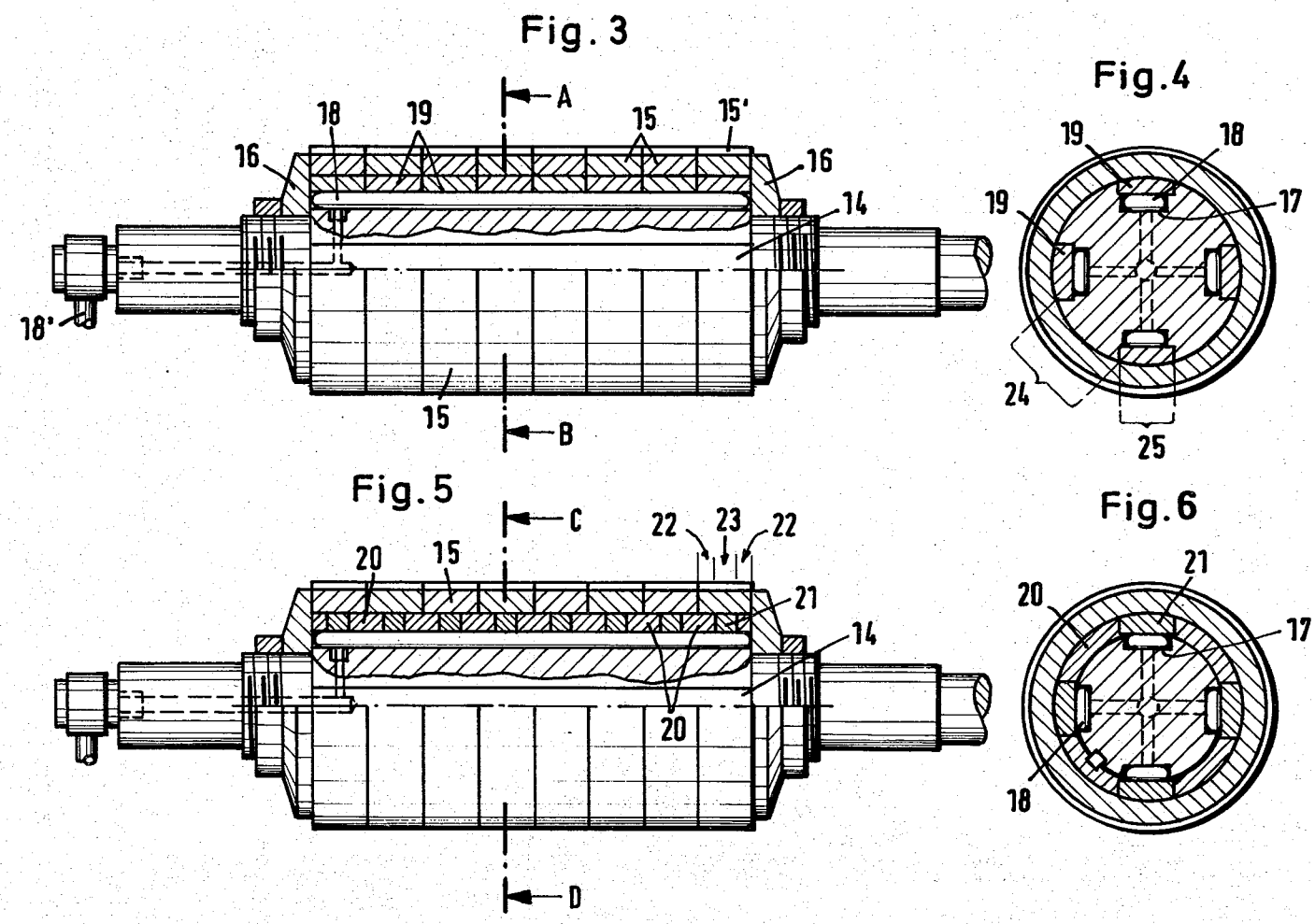
FIG. 3 shows a brake roll viewed from the side and partly in axial cross-section.
FIG. 4 shows a cross-section A-B through the brake roll of FIG. 3.
FIG. 5 shows another brake roll viewed from the side and partly in axial cross-section.
FIG. 6 shows a cross-section C-D through the brake roll according to FIG. 5.

The brake roll shown in FIGS. 3 and 4 comprises a shaft 14 on which in axial span several runner rings 15 are slidingly disposed adjacent to one another and are freely rotatable independently of one another. The runner rings 15 are bordered on their front sides between the discs 16. The runner rings 15 have on their outer periphery a coating 15' of rubber or other material for spanning the band strips free of slippage.

The actuated or braked shaft 14 has in its outer peripheral area four radially open channels 17 running in axial direction each to receive a hose 18 which can be filled with pressure means and several brake members 19. By filling these hoses 18 with compressed air through a rotatable pressure means connection 18' the brake members 19 are pressed radially against the respective inner surface of the runner ring 15 and thus effect an even braking of all runner rings 15 in peripheral direction with balance of clearance at the same time.

The brake roll shown in FIGS. 5 and 6 is the same in working method as the braking roll according to FIGS. 3 and 4. A bush 20 is in addition arranged non-rotatably on the shaft 14, said bush 20 having radial openings to receive the brake members 21 form-lockingly. The brake members 21 are narrower in width than the respective runner ring 15. This results in running zones 22 separated by a braking zone in axial direction.

In the embodiment according to FIGS. 3 and 4 the brake members 19 extend over the entire width of the runner ring 15. In this case the abrasion resistance of the running surface 24 of the shaft 14 and of the braking surface 25 of the brake member 19 should be less than that of the ring 15 and a predetermined minimum relationship between the curve length of the running zone 24 and the curve length of the braking zone 25 should be kept to.

In the embodiment according to FIGS. 5 and 6 the more heavily abrading part is the runner ring 15 and the less heavily abrading part is the bush 20 and the brake member 21. As FIG. 5 shows, each brake member 21 extends only about over a third of the axial width of the runner ring 15 and therefore only this narrow central area 23 is subject to braking abrasion, the outer areas 22, on the other hand, are only subject to pure running abrasion. Due to the distinct separation into braking zone 23 and running zone 22 in the runner ring 15 a longer time of operation up until the maximum guide clearance permitted is provided.

Through the following formula applying to an abrasion equal to 0 on the less heavily abrading part the limit value for the relationship of braking surface and running surface can be determined from which a longer time of operation up until the maximum guide clearance permitted results:

$$V_L < \frac{(V_L \cdot F_L) + (V_B \cdot F_B)}{F_L + F_B}$$

The meaning of the symbols in this formula is as follows:

$V_L$=running abrasion=½ guide clearance (mm)
$F_L$=running surface (mm²)
$V_B$=braking abrasion (mm)
$F_B$=surface area of the brake member (mm²).

It is of course possible to combine the two embodiments. It is also possible in the axial division that the running zone has the heavier abrasion on the inner part whereas the braking zone has the heavier abrasion on the outer part or vice versa.

The invention is not only suited for winding devices but also for winding off devices.

I claim:

1. A brake roll for spanning several, adjacently guided bands comprising:
   a. a shaft;
   b. a plurality of runner rings slidingly disposed on said shaft;
   c. radially movable brake members disposed between said shaft and said rings, in sliding contact with said rings, for braking said rings with respect to said shaft;
   d. means to apply a radial pressure load to said brake member; and
   e. the one of said runner rings and brake members which is more heavily abrading divided up into running zones and braking zones, pressure being applied to said means to apply only in said braking zones.

2. A brake roll according to claim 1, wherein said more heavily abrading part is divided up in the peripheral direction.

3. A brake roll according to claim 1, wherein the more heavily abrading part is divided up in the axial direction.

4. A brake roll according to any of claims 1 to 3, wherein the running and braking surfaces are determined such as to satisfy the following equation $$V_L < \frac{(V_L \cdot F_L) + (V_B \cdot F_B)}{F_L + F_B} \text{ in (mm), where}$$

$V_L$=running abrasion in (mm)
$F_L$=running surface in (mm²)
$V_B$=braking abrasion in (mm)
$F_B$=surface area of the brake member in (mm²)

5. A brake roll according to claim 1, wherein said means to apply pressure to said brake members comprise fluid pressure means.

6. A brake roll according to claim 5, wherein the brake members are disposed in said shaft.

7. A brake roll according to claim 5, wherein said shaft includes a bushing and further including a joint pressure pad, said brake members disposed on said joint pressure pad.

* * * * *